United States Patent [19]

Bruss

[11] Patent Number: 4,836,462

[45] Date of Patent: Jun. 6, 1989

[54] TOILET TISSUE DISPENSER

[76] Inventor: Elroy A. Bruss, N17 W5441 Garfield St., Cedarburg, Wis. 53012

[21] Appl. No.: 260,910

[22] Filed: Oct. 21, 1988

[51] Int. Cl.[4] ..... B65H 19/00

[52] U.S. Cl. ..... 242/55.3; 242/55.53

[58] Field of Search ..... 242/55.2, 55.3, 55.53

[56] References Cited

U.S. PATENT DOCUMENTS

| | | | |
|---|---|---|---|
| 2,658,690 | 11/1953 | Hill | 242/55.2 |
| 2,805,030 | 9/1957 | Wolters | 242/55.3 |
| 2,908,450 | 10/1959 | Stone et al. | 242/55.3 |

*Primary Examiner*—David Werner

*Attorney, Agent, or Firm*—Andrus, Sceales, Starke & Sawall

[57] ABSTRACT

The toilet tissue dispenser of this invention requires framing means including a rearwardly disposed wall mounting member and a forwardly disposed tissue roll mounting member. The roll mounting member has a pivotal connection at one end thereof to provide for pivotal movement of the member relative to the wall mounting member between an open position providing for the replenishment of tissue rolls over the free end of the member and a closed position. A roll housing is slidably disposed on the roll mounting member and has an open end facing toward the free end of said member. At the time of replenishment the housing receives spare rolls of tissue therein. The housing is spaced from the free end of the roll mounting member to provide for a roll of tissue on the member in the in-use position clear of the housing. The roll housing is slidable on the roll mounting member toward the free end thereof to place a new roll of tissue in the in use position after the previous roll has been consumed.

8 Claims, 3 Drawing Sheets

TOILET TISSUE DISPENSER

NATURE AND SUMMARY OF THE INVENTION

This invention relates to a toilet tissue dispenser, and more particularly to a multiple roll dispenser.

The toilet tissue dispenser of this invention requires framing means including a rearwardly disposed wall mounting member and a forwardly disposed tissue roll mounting member. The roll mounting member has a pivotal connection at one end thereof to provide for pivotal movement of the member relative to the wall mounting member between an open position providing for the replenishment of tissue rolls over the free end of the member and a closed position. A roll housing is slidably disposed on the roll mounting member and has an open end facing toward the free end of said member. At the time of replenishment the housing receives spare rolls of tissue therein. The housing is spaced from the free end of the roll mounting member to provide for a roll of tissue on the member in the in-use position clear of the housing. The roll housing is slidable on the roll mounting member toward the free end thereof to place a new roll of tissue in the in-use position after the previous roll has been consumed.

DESCRIPTION OF THE DRAWING FIGURES

The drawings furnished herewith illustrate the best mode presently contemplated and are described hereinafter.

DESCRIPTION OF THE ILLUSTRATED EMBODIMENT

Figure 1:
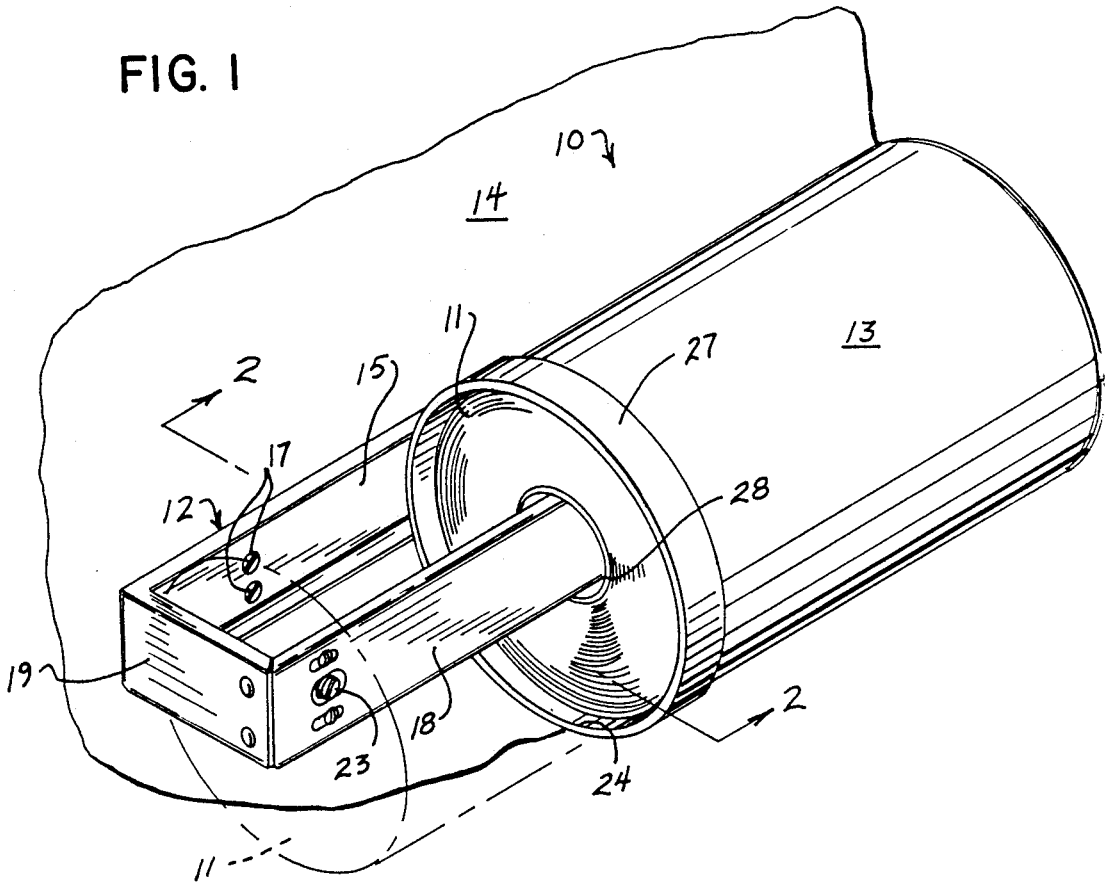
FIG. 1 is a perspective view of the toilet tissue dispenser of this invention shown mounted on a wall and with the roll of tissue in use being shown in dot-dash lines.

Referring to the drawings, the toilet tissue dispenser 10 accommodates a plurality of rolls 11 of toilet tissue and comprises generaly a frame 12 and a roll housing 13. The dispenser 10 is adapted for mounting on a wall 14.

Figure 3:
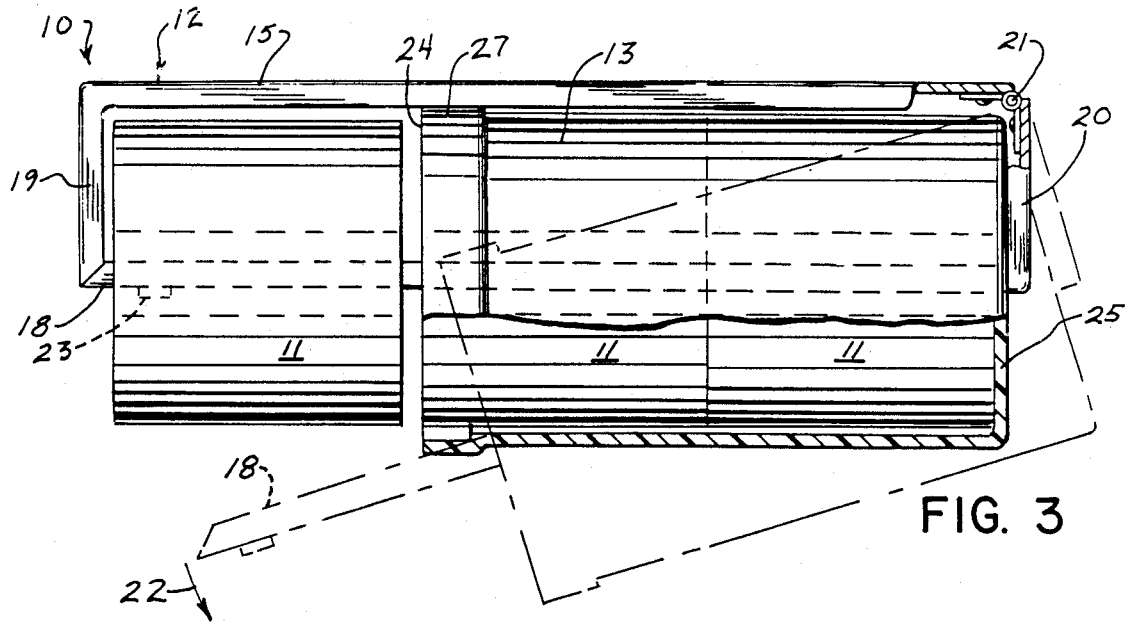
FIG. 3 is a plan view of the tissue dispenser with parts broken away and sectioned, and in dot-dash lines showing the dispenser in the unlocked and open condition as for the loading of rolls of tissue.

As viewed in plan, the frame 12 of the dispenser 10 has a generally rectangular configuration. The frame 12 includes a rearwardly disposed reach 15 which is provided with holes 16, as desired, for receiving and passing screws 17 or the like for wall mounting the dispenser. A forward reach 18 is spaced from and generally parallels the rear reach 15 and is adapted to mount a plurality of rolls 11 of toilet tissue. A pair of spaced and parallel orthogonal end reaches 19 and 20, respectively, connect the corresponding ends of the rear and forward reaches 15 and 18. For enhanced strength, all of the framing reaches 15, 18, 19 and 20 may be channel section members having their flanges directed inwardly relative to the rectangular configuration of the frame 12. To provide for the loading of tissue rolls 11, the frame 12 of the dispenser 10 must be openable. For openability, a hinge 21 is interposed between the rear reach 15 and the adjacent end reach 20 as shown in FIG. 3. Diagonally opposite from the hinge 21, the forward reach 18 partingly opens relative to the end reach 19 as indicated by the arrow 22 for the dot-dash representation of the forward reach. In the full open position, the forward reach 18 will extend generally normal relative to the plane of the rear reach 15. A lock 23 is carried on the free end of the forward reach 18 which lockingly engages with the end reach 19 when the reaches are closed after loading. The lock 23 may be opened or unlocked with a key, not shown.

Figure 2:
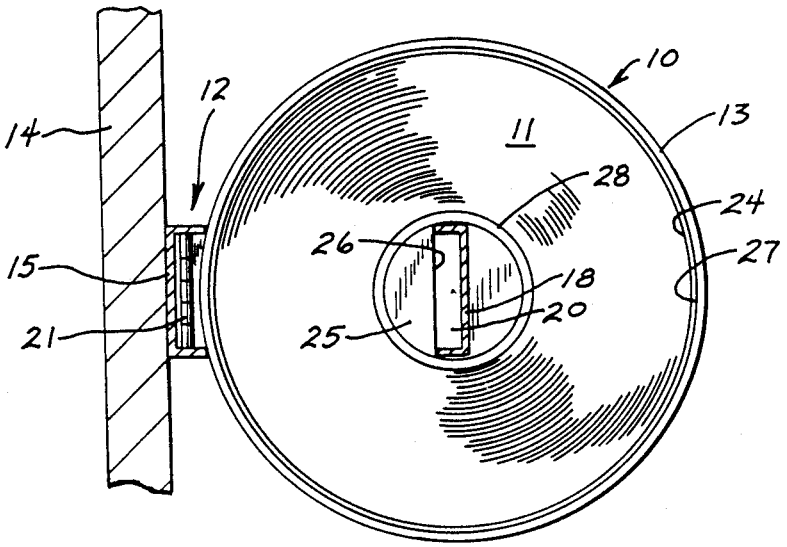
FIG. 2 is a sectional view taken generally on the line 2—2 of FIG. 1.

The roll housing 13 is slidably disposed on the forward framing reach 18. The tubular housing 13 is generally cylindrical and is provided with an open entrance or mouth 24 facing toward the end reach 19. Rearwardly the housing 19 has a rear closure 25 that is provided generally centrally thereof with a generally rectangular opening 26 for slidably engaging upon the forward reach 18 as shown in FIG. 2. In the normal position of the roll housing 13, the rear closure 25 engages with the end reach 20. As shown in FIG. 2, the length of the end framing reaches 19 and 20, respectively, are selected to place the circumference of the roll housing 13 generally adjacent to the rear framing reach 15.

To load the dispenser 10, the lock 23 is unlocked and the forward framing reach 18 is pivoted open as indicated by the arrow 22 as shown in FIG. 3. With the frame 12 open, three (3) rolls 11 are slipped onto the front framing reach 18, with two (2) rolls being inserted within the housing 13. To make the insertion of rolls 11 into the housing 13 easier, the mouth 24 thereof may be somewhat enlarged as shown at 27. With the roll housing 13 disposed in its normal position engaged upon the end framing reach 20, the remainder of forward reach 18 will support the further tissue roll 11 in the in-use position between the housing and the end reach 19. The roll 11 in the in-use position extends over and generally hides the lock 23.

If the width of the forward framing reach 18 is selected to be smaller than the diameter of the hollow paper core 28 for the tissue rolls 11, the rolls will rotate as desired when in use. The width of the reach 18 should, however, closely approach the diametral dimension of the cores 28. With the framing reach 18 closely approaching the diametral dimension of the cores 28, the rolls 11 slipped onto the front reach will then be disposed in generally good alignment for entry into the roll housing 13. While the width of the framing reaches 15, 19 and 20 may differ from that of the forward reach 18, the reaches may nevertheless all have the same width as here for appearance or other considerations.

Figure 4:
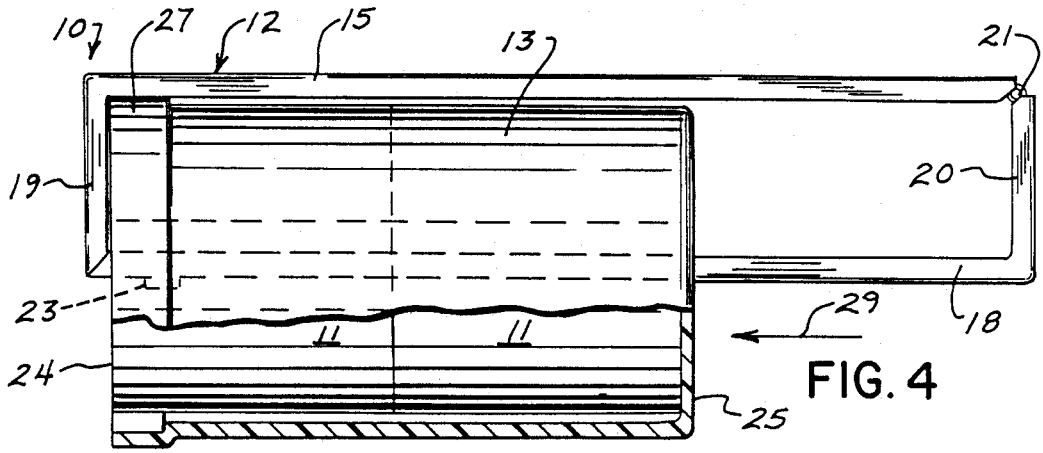
FIG. 4 is a plan view with parts broken away and sectioned, and shows the spare roll housing moved to place the next or second roll of tissue in position for use.
Figure 5:
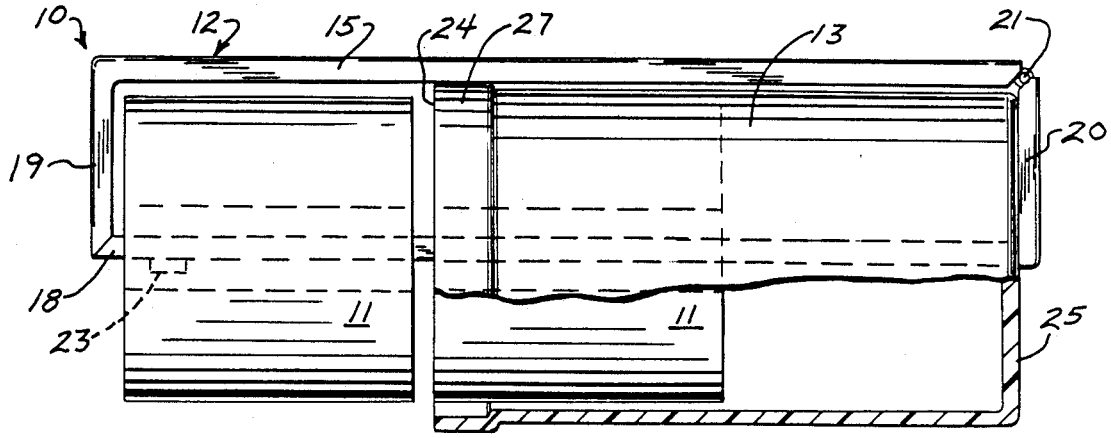
FIG. 5 is a view generally similar to that of FIG. 4 and shows the roll housing returned to its normal position after moving the next or second roll of tissue into position for use.

When the roll 11 of tissue in the in-use position has been consumed, the corresponding now empty core 28 is removed to render the framing reach 18 completely clear between the roll housing 13 and the end framing reach 19. Thereafter, the roll housing 13 is slidably moved on the frame reach 18 in the direction of the arrow 29 to engage the mouth or entrance end 24 of the roll housing with the end framing reach 19 as generally shown in FIG. 4. Since the tissue rolls 11 are afforded some clearance relative to the housing 13, the rolls moved by the housing generally remain in place in their new position when the housing is slidably returned to its normal position, as generally shown in FIG. 5. Thus, the roll 11 that was within the housing and adjacent to the mouth 24 is now in the in-use position and the roll that was within the housing and adjacent to the end closure 25 still remains in the housing but is now adjacent to the mouth. When the second roll 11 in the in-use position has been consumed and its empty core 28 removed from the framing reach 18, the third and final roll can be manually pulled out of the roll housing 13 and into the in-use position. Anytime after even but a single roll 11 has been consumed, the remaining roll-/rolls can be moved to expose the lock 23 for purposes of replenishment.

Figure 6:
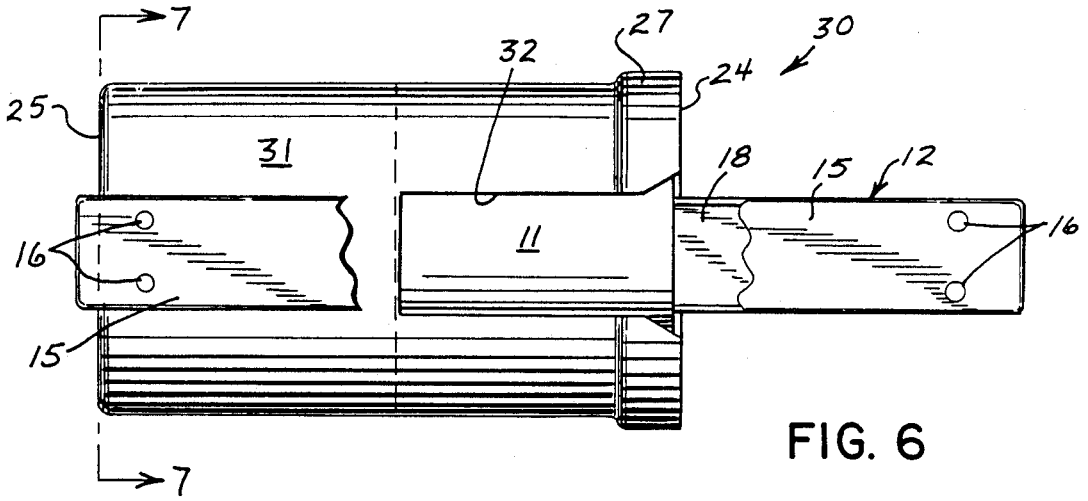
FIG. 6 is a rear elevation with a part broken away and shows a further embodiment of the invention wherein the roll housing is provided with a recess or slot that opens at the forward end of the housing.
Figure 7:
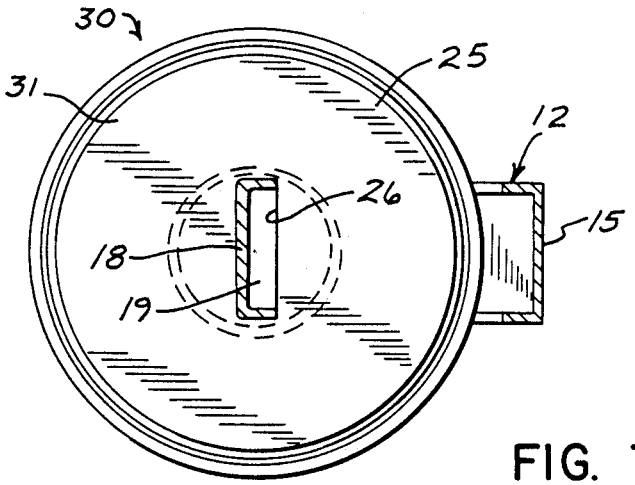
FIG. 7 is a sectional view taken generally on the line 7—7 of FIG. 6.
Figure 8:
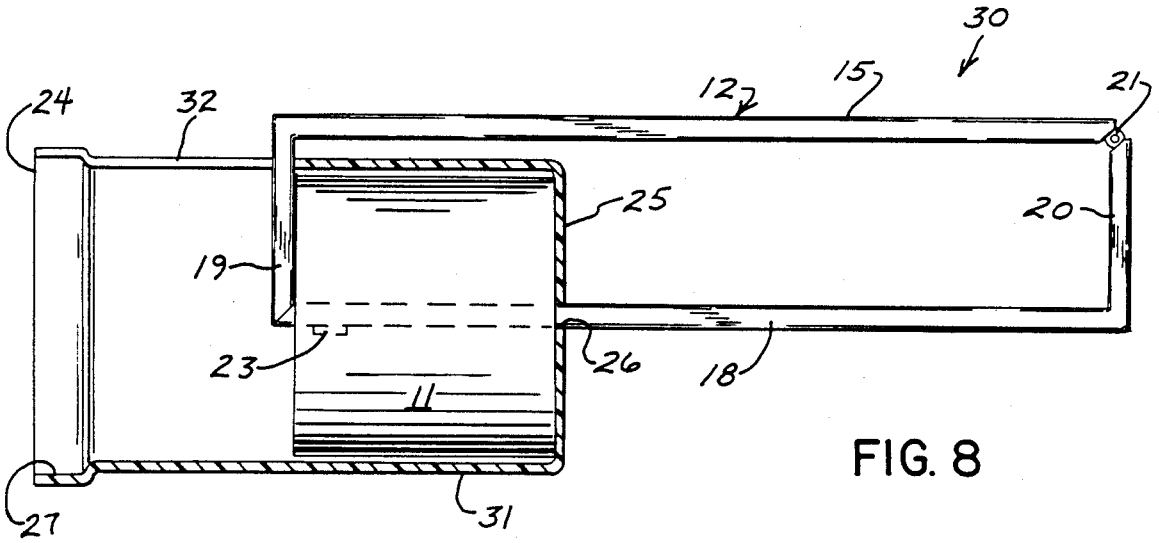
FIG. 8 is a plan view of the dispenser of FIG. 6 and shows the roll housing as moved to place the final roll of tissue into position for use.

For the dispenser 30 in the embodiment of FIGS. 6–8, like reference numerals are used for similar parts previously described in FIGS. 1–5.

In the dispenser 30, the roll housing 31 is provided with a recess or slot 32 that opens toward the entrance end of the housing and is disposed in alignment with the end framing reach 19. The width of the slot 32 somewhat exceeds the width of the end reach 19 so that the end reach can be received within the slot.

After the second roll 11 has been consumed and the corresponding paper core 28 removed from the forward framing reach 18, the third and final roll can be brought into the in-use position by sliding movement of the housing 31 as guided on the forward reach. The housing slot 32 provides for movement of the mouth or entrance end 24 of the housing 31 past the end framing reach 19 as shown in FIG. 8, and the length of the slot is selected to provide for movement of the housing sufficient to bring the final roll into the in-use position. Thereafter, the housing 31 may be returned to its normal position.

Maids, janitors and others having responsibility for monitoring, cleaning etc. guest and public restroom facilities generally have many other duties to perform as well. When single roll tissue dispensers are employed, an inordinate amount of time is spent with monitoring and replenishment to the detriment of those other duties. While sometimes spare rolls are additionally left in the restroom facility, such rolls often disappear or are vandally wasted.

With the multiple roll dispenser of this invention, spare rolls can be provided in a manner to generaly preclude disappearance and needless waste, and monitoring personnel will have more time for their other duties. Since the spare rolls remain indisposed until the roll in the in-use position is entirely consumed, waste is deterred. Until the spare rolls are actually required, they remain in the generally clean and dry environment of the roll housing.

Various modes of carrying out the invention are contemplated as being within the scope of the following claims particularly pointing out and distinctly claiming the subject matter which is regarded as the invention.

I claim:

1. In a toilet tissue dispenser, framing means including a rearwardly disposed wall mounting member and a forwardly disposed tissue roll mounting member, said roll mounting member having a pivotal connection at one end thereof to provide for pivotal movement of said member relative to the wall mounting member between an open position providing for replenishment of tissue rolls over the free end of said member and a closed position, a roll housing slidably disposed on the roll mounting member and having an open end facing toward the free end of said member, said housing being adapted to receive spare rolls of tissue therein and being spaced from the free end of said roll mounting member to provide for a roll of tissue in the in-use position clear of said housing, said roll housing being slidable on the roll mounting member toward the free end thereof to place a new roll of tissue in the in-use position after the previous roll has been consumed.

2. The structure as set forth in claim 1 wherein the wall mounting member and the roll mounting member are generally L-shaped members, respectively, said members being disposed to define a generally rectangular configuration wherein one end of the roll mounting member is pivotally connected to the wall mounting member, and closure means are provided between the opposite ends of said members.

3. The structure as set forth in claim 2 wherein the closure means comprises a locking mechanism.

4. The structure as set forth in claim 3 wherein the locking mechanism comprises a key operated lock which is covered by the roll of tissue in the in-use position to generally hide the lock from view.

5. The structure as set forth in claim 1 wherein the roll housing is generally cylindrical to accommodate the rolls of tissue and has a generally closed end opposite from the open end thereof, said closed end of said housing having an opening generally centrally thereof, said opening having a configuration to slidably receive and move upon the roll mounting member.

6. The structure as set forth in claim 5 wherein the roll housing can accommodate at least a pair of rolls of tissue.

7. The structure as set forth in claim 5 wherein the roll housing can accommodate a pair of rolls of tissue, said housing having a slot in the wall thereof opening toward the open end of the housing, said slot being adapted to receive a portion of the wall mounting member when the roll housing is slidably moved to place the last roll of tissue in the in-use position.

8. The structure as set forth in claim 1 wherein the wall mounting member and the roll mounting member are generally L-shaped members, respectively, said L-shaped wall mounting member comprising a wall mounting portion and an orthogonal portion and said L-shaped roll mounting member comprising a roll mounting portion and an orthogonal portion, said orthogonal portion of the roll mounting member being pivotally connected to the remote end of the wall mounting portion and closure means between the opposite ends of said members, said members defining a generally rectangular configuration upon closure of said members.

* * * * *